US006095927A

United States Patent [19]

Malone

[11] Patent Number: 6,095,927

[45] Date of Patent: Aug. 1, 2000

[54] WATER MAZE

[76] Inventor: Andrew Malone, 3103 Frisby St., Baltimore, Md. 21218

[21] Appl. No.: 09/405,702

[22] Filed: Sep. 24, 1999

[51] Int. Cl.[7] ..... A63J 11/00

[52] U.S. Cl. ..... 472/62; 472/128

[58] Field of Search ..... 472/62, 117, 128, 472/136, 137; 273/349, 440, 440.1

[56] References Cited

U.S. PATENT DOCUMENTS 4,142,724 3/1979 Reick ..... 273/109
4,154,440 5/1979 Rusk ..... 472/62
5,425,677 6/1995 Gleeson et al. ..... 472/136
5,474,501 12/1995 Teng ..... 472/62
5,906,373 5/1999 Sanders ..... 273/349

*Primary Examiner*—Kien T. Nguyen

[57] ABSTRACT

A new water maze for providing a unique and refreshing attraction for amusement parks and other similar facilities. The inventive device includes a labyrinth having a plurality of passages, operative and inoperative sprinkler heads in the ceilings of certain passages, a water supply system to supply water to the operative sprinkler heads, and a motion sensor associated with each operative sprinkler head to activate the discharge of water therefrom for a predetermined length of time when a person enters an incorrect passage.

9 Claims, 3 Drawing Sheets

WATER MAZE

BACKGROUND OF THE INVENTION

1. Field of the Invention

The present invention relates to amusement devices and more particularly pertains to a new water maze for providing a unique and refreshing attraction for amusement parks and other similar facilities.

2. Description of the Prior Art

The use of amusement devices is known in the prior art. More specifically, amusement devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art amusement devices include U.S. Pat. No. 4,674,753; U.S. Pat. No. 4,008,895; U.S. Pat. No. 5,303,778; U.S. Pat. No. 4,180,268; U.S. Pat. No. Des. 325,403 and U.S. Pat. No. 4,850,592.

While these devices fulfill their respective, particular objectives and requirements, the aforementioned patents do not disclose a new water maze. The inventive device includes a labyrinth having a plurality of passages, operative and inoperative sprinkler heads in the ceilings of certain passages, a water supply system to supply water to the operative sprinkler heads, and a motion sensor associated with each operative sprinkler head to activate the discharge of water therefrom for a predetermined length of time.

In these respects, the water maze according to the present invention substantially departs from the conventional concepts and designs of the prior art, and in so doing provides an apparatus primarily developed for the purpose of providing a unique and refreshing attraction for amusement parks and other similar facilities.

SUMMARY OF THE INVENTION

In view of the foregoing disadvantages inherent in the known types of amusement devices now present in the prior art, the present invention provides a new water maze construction wherein the same can be utilized for providing a unique and refreshing attraction for amusement parks and other similar facilities.

The general purpose of the present invention, which will be described subsequently in greater detail, is to provide a new water maze apparatus and method which has many of the advantages of the amusement devices mentioned heretofore and many novel features that result in a new water maze which is not anticipated, rendered obvious, suggested, or even implied by any of the prior art amusement devices, either alone or in any combination thereof.

To attain this, the present invention generally comprises a labyrinth having a plurality of passages, operative and inoperative sprinkler heads in the ceilings of certain passages, a water supply system to supply water to the operative sprinkler heads, and a motion sensor associated with each operative sprinkler head to activate the discharge of water therefrom for a predetermined length of time.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new water maze apparatus and method which has many of the advantages of the amusement devices mentioned heretofore and many novel features that result in a new water maze which is not anticipated, rendered obvious, suggested, or even implied by any of the prior art amusement devices, either alone or in any combination thereof.

It is another object of the present invention to provide a new water maze which may be easily and efficiently manufactured and marketed.

It is a further object of the present invention to provide a new water maze which is of a durable and reliable construction.

An even further object of the present invention is to provide a new water maze which is susceptible of a low cost of manufacture with regard to both materials and labor, and which accordingly is then susceptible of low prices of sale to the consuming public, thereby making such water maze economically available to the buying public.

Still yet another object of the present invention is to provide a new water maze which provides in the apparatuses and methods of the prior art some of the advantages thereof, while simultaneously overcoming some of the disadvantages normally associated therewith.

Still another object of the present invention is to provide a new water maze for providing a unique and refreshing attraction for amusement parks and other similar facilities.

Yet another object of the present invention is to provide a new water maze which includes a labyrinth having a plurality of passages, operative and inoperative sprinkler heads in the ceilings of certain passages, a water supply system to supply water to the operative sprinkler heads, and a motion sensor associated with each operative sprinkler head to activate the discharge of water therefrom for a predetermined length of time.

Still yet another object of the present invention is to provide a new water maze that cools parks patrons on a hot day.

Even still another object of the present invention is to provide a new water maze that both challenges and amuses a person at the same time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
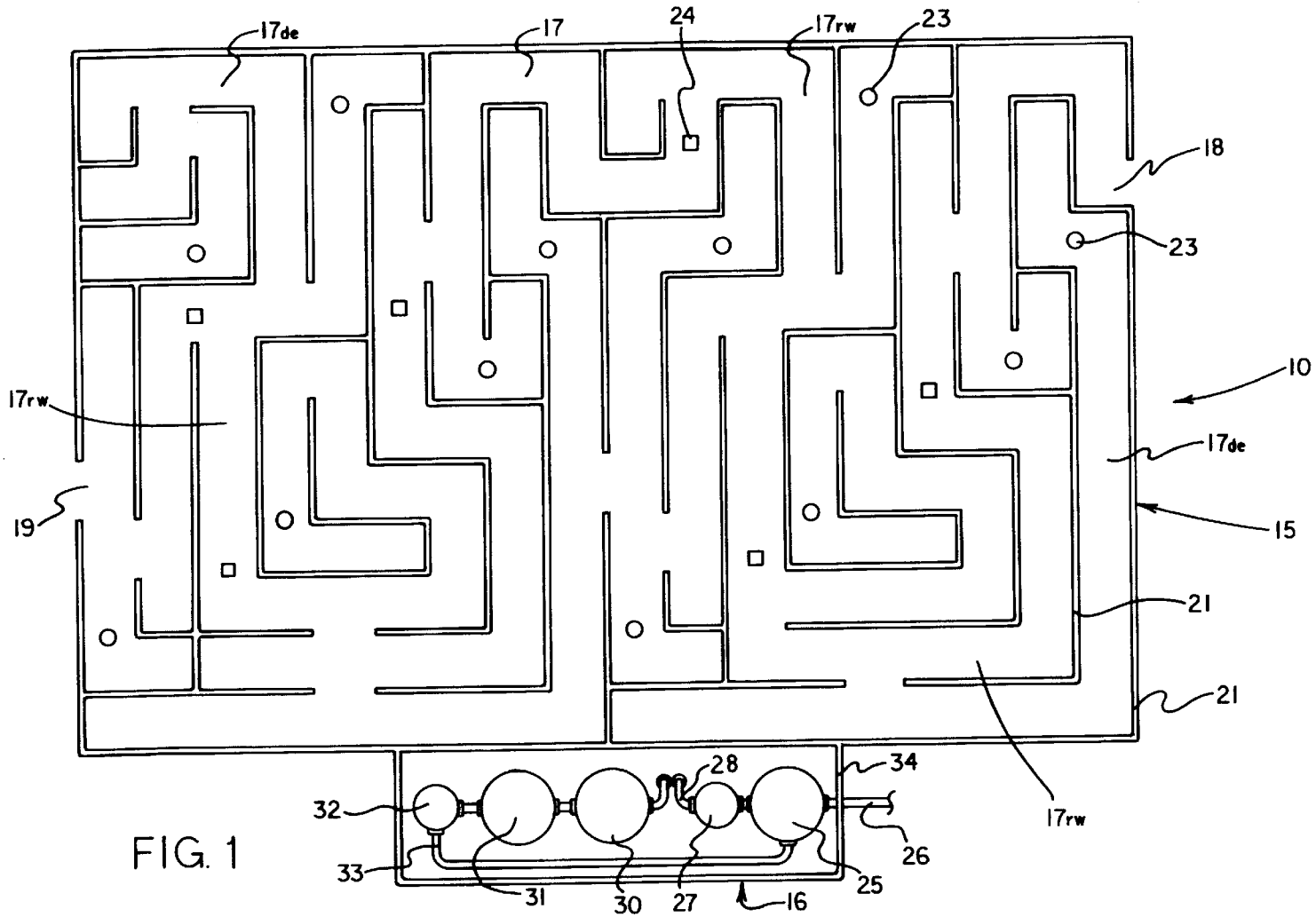
FIG. 1 is a top view of a new water maze according to the present invention with the ceiling removed.
Figure 2:
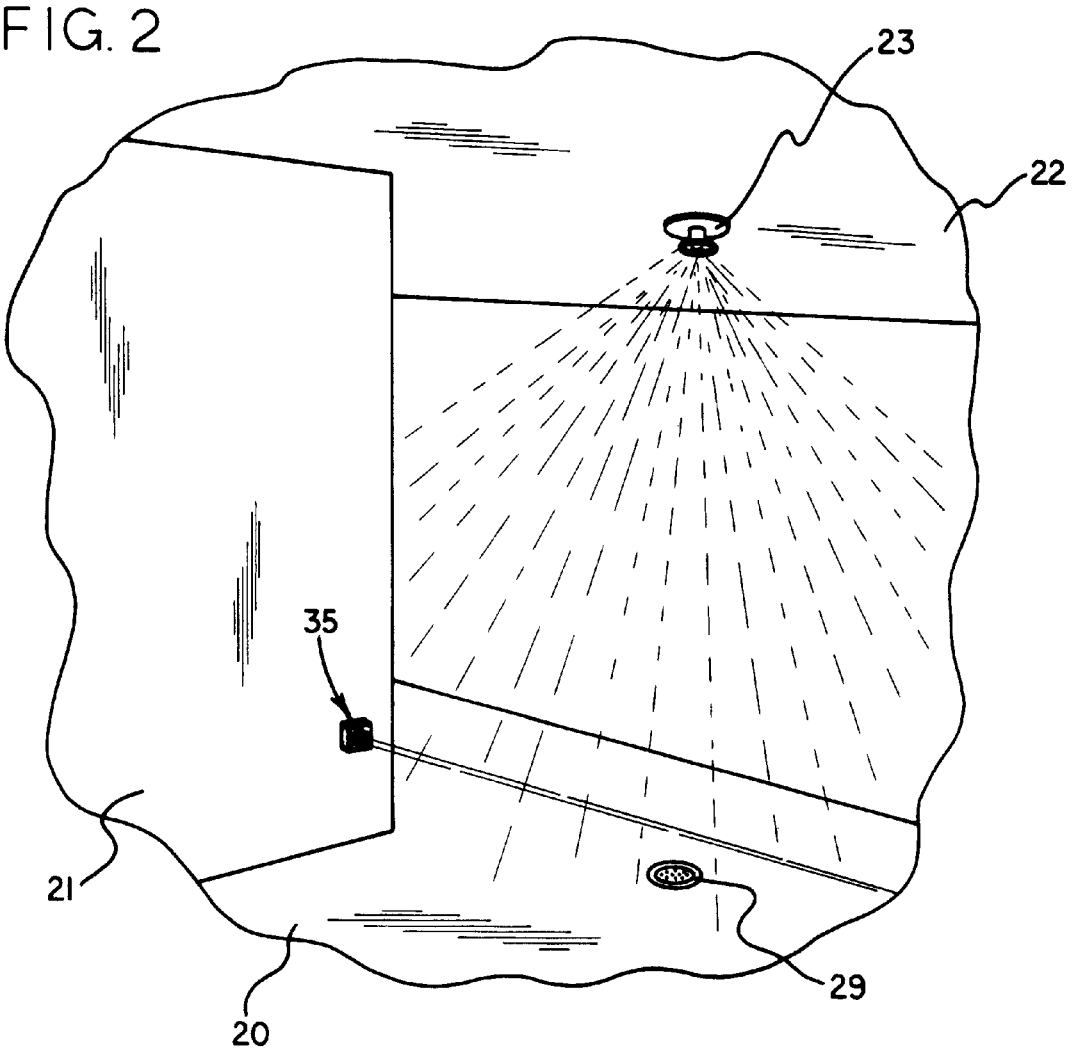
FIG. 2 is a view of one of the dead end passages having a sprinkler head and motion sensor.
Figure 3:
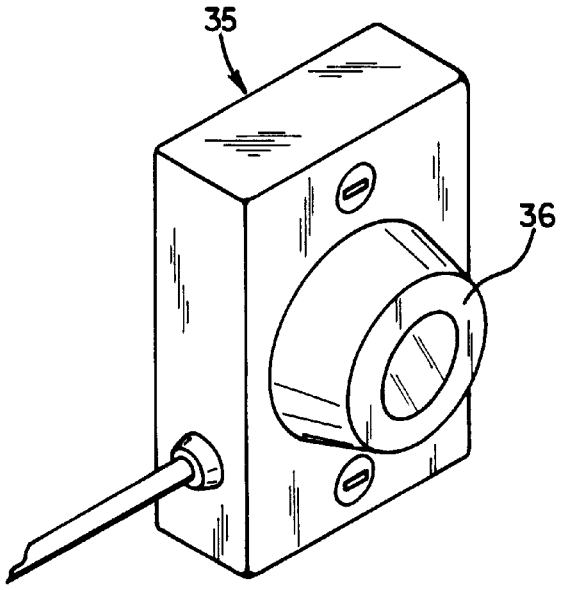
FIG. 3 is a view of an exemplary motion sensor.
Figure 4:
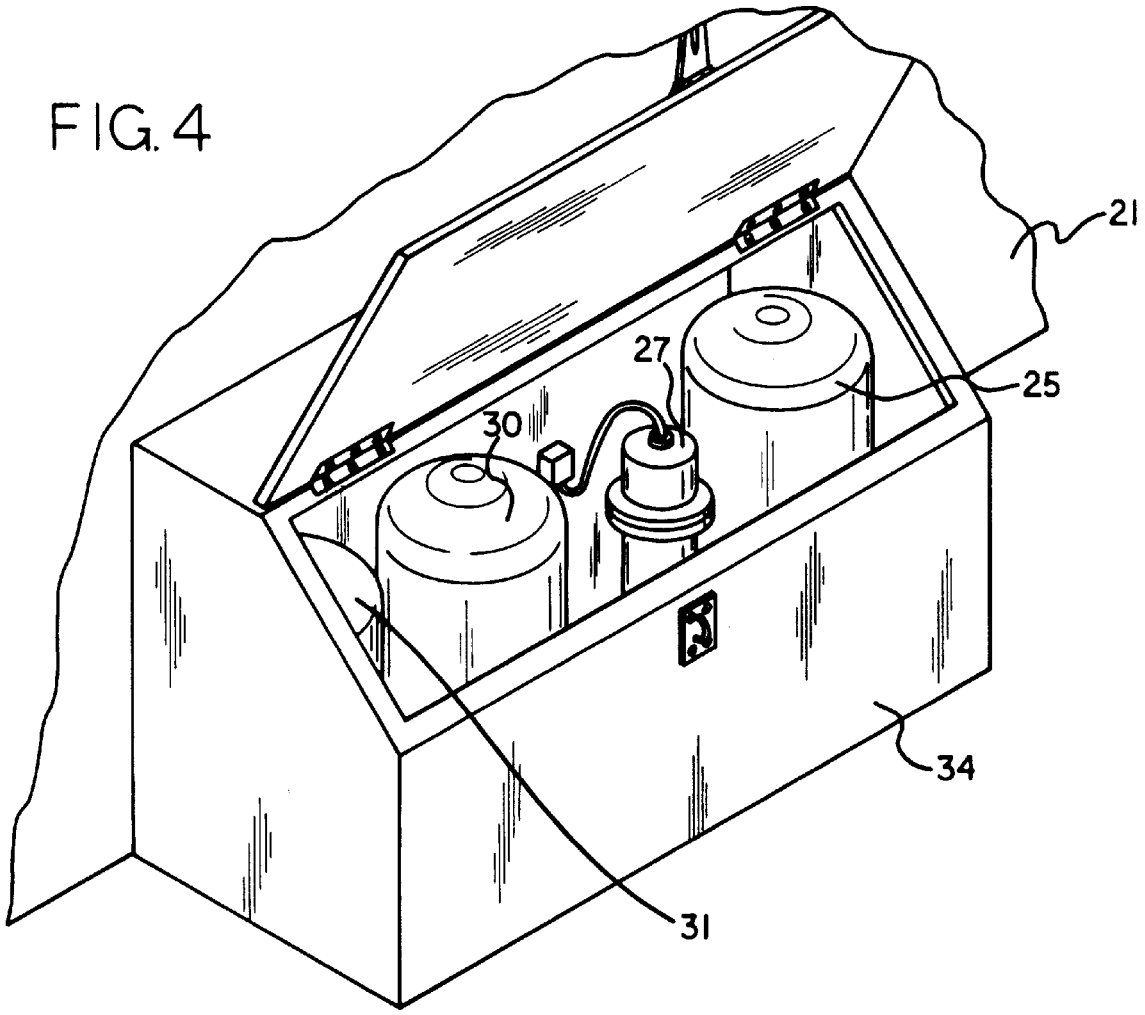
FIG. 4 is a view of the water supply and collection system.

With reference now to the drawings, and in particular to FIGS. 1 through 4 thereof, a new water maze embodying the principles and concepts of the present invention and generally designated by the reference numeral 10 will be described.

More specifically, it will be noted that the water maze 10 comprises a labyrinth 15 and a water supply and collection system 16 attached thereto.

As best illustrated in FIGS. 1 through 4, it can be shown that the labyrinth 15 is composed of a plurality of passages 17 connected together to form a confusing maze. The labyrinth 15 includes an entrance 18 at one end and an exit 19 at the other end. The entrance 18 and exit 19 are connected by the series of passages 17.

The passages 17 which define the labyrinth 15 are comprised of a plurality of right-way passages and a plurality of dead end passages. The right-way passages are those passages 17 which lead a person on the correct path towards the exit 19, such as passages 17*rw*. The dead end passages are those passages 17 which are closed and do not lead a person on the correct path towards the exit 19, such as passages 17*de*.

The passages 17 are large enough to allow groups of people to walk therethrough. The labyrinth 15 is formed on a base 20 which defines a floor for each passage. Walls 21 extend upward from the base 20 to define side walls for the passages 17. A ceiling 22 is disposed over the base 20 and attached to the top of the walls 21, thus defining substantially closed passages 17. Thus as should be easily recognized, people enter the labyrinth through entrance 18, and walk through the passages 17 trying to get to the exit 19. The incorrect path will invariably be taken, and through trial and error the correct path is finally taken leading to the exit. Since the passages are closed, a person cannot see into adjacent passages or outside to get his bearings.

To make the maze 10 more interesting and fun, and to also provide an indication that a person has taken a wrong turn, operational sprinkler heads 23 are mounted to the ceiling 22 in some, or all, of the dead end passages 17*de*. The sprinkler heads 23 are located on the ceiling at some point previous to the very end of the dead end passages, so that a person does not walk all the way to the dead end before encountering the sprinkler head. FIG. 1 shows circles representing the possible locations of sprinkler heads 23 along some of the dead end passages. It should be recognized that each dead end passage could include a sprinkler head 23.

In addition, a plurality of dummy sprinkler heads 24, represented by squares in FIG. 1, can be mounted to the ceiling in the right-way passages 17*rw*. The dummy sprinkler heads 24 are identical to the sprinkler heads 23, except that the dummy heads 24 are not operational. Thus, when wandering through the passages, one cannot tell whether he/she is approaching an operational or fake sprinkler head. The dummy heads 24 could also be placed within certain dead end passages to further increase confusion.

The operational sprinkler heads 23 are supplied with water by the water supply and collection system 16. The system 16 includes a supply water tank 25 connected to a water supply through inlet pipe 26. The tank 25 is connected to the inlet of a pump 27, whose outlet 28 is connected to the operational sprinkler heads 23. The floor 20 includes appropriately located drains 29 (only one being shown in FIG. 2) which are connected to the inlet of a sludge tank 30. The sludge tank 30 separates used water from undesirable materials, collected by the drains 29. The separated water from tank 30 is input into tank 31 and from there pumped by pump 32 back into tank 25 through line 33. The components of the system 16 can be disposed inside a housing 34 attached to the back side of the maze 10.

The operational sprinkler heads 23 are controlled such that they discharge water only when activated to do so. Such controlled sprinkler heads are generally known, and therefore no further discussion of such is needed. The sprinkler heads 23 are activated by motion sensors 35 located within the passages containing operational sprinkler heads 23. The sensors 35 are located in the passages proximate the associated sprinkler heads 23 and electrically connected thereto. The motion sensors 35 can comprise any type of motion sensor which can sense motion in the passages adjacent the heads 23. As illustrated, the motion sensors 35 are mounted on the side walls and comprise a light emitting unit 36 which emits a beam of light across the passage toward the opposite side wall. When a person breaks the light beam, this is sensed by the sensor 35, which activates its associated sprinkler head 23 to discharge a spray of water onto the person who breaks the light beam. The spray will last for only a certain predetermined length of time, then the head 23 will again be shut-off. The light beam is preferably invisible to the eye so no advanced warning is given. The motion sensors can also be flush mounted in the side walls, or disguised on the side walls, to prevent advanced warning.

In use, as stated previously, people enter the maze through the entrance 18 and wander through the passages 17 trying to reach the exit 19. Invariably, wrong turns will be taken into the dead end passages 17*de*. People walking into a dead end passage will eventually break the light beam from the motion sensor 35, thus causing a discharge of water from the sprinkler head 23. This water discharge not only gets the people wet, but it also is an indication that a wrong turn has been taken and that they must turn around. By placing the dummy sprinkler heads 24 within the passages 17, people have no idea whether a sprinkler head they see is operational or fake so they cannot try to avoid it. Eventually the people reach the exit 19 after having gotten wet and discovered the correct path.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water maze comprising:

a labyrinth having passages, each passage including a floor and a ceiling;

operative sprinkler heads mounted in the ceilings of a plurality of said passages;

water supply and collection means for supplying water to, and collecting water discharged from, the operative sprinkler heads; and an activation means associated with each operative sprinkler head for activating the discharge of water therefrom for a predetermined length of time.

2. The water maze of claim 1, wherein the passages include dead end passages, said operative sprinkler heads being mounted in the ceilings of said dead end passages.

3. The water maze of claim 1, wherein the water supply and collection means comprises a supply pump connected to a supply tank for supplying water to the operative sprinkler heads, and a collection pump for pumping discharged water to the supply tank.

4. The water maze of claim 1, wherein each said activation means comprises a motion sensor located adjacent its associated operative sprinkler head in the respective passage.

5. The water maze of claim 1, further comprising a plurality of inoperative sprinkler heads mounted in the ceilings of a further plurality of said passages.

6. A water maze amusement apparatus, comprising:

a labyrinth having passages, said passages including a plurality of dead end passages and a plurality of right-way passages, each passage including a floor, side walls, and a ceiling;

an operative sprinkler head mounted in the ceiling of at least one of said dead end passages and an inoperative sprinkler head mounted in the ceiling of at least one of said right-way passages;

a water supply pump having its input connected to a water supply tank and its output connected to the operative sprinkler head for supplying water to the operative sprinkler head;

a collection pump for pumping water which is discharged from the operative sprinkler head to the water supply tank;

a motion sensor associated with the operative sprinkler head for activating the discharge of water therefrom for a predetermined length of time, said motion sensor being mounted on one of said side walls of said one dead end passage proximate said operative sprinkler head.

7. The water maze amusement apparatus of claim 6, wherein a plurality of said dead end passages include an operative sprinkler head.

8. The water maze amusement apparatus of claim 7, wherein a plurality of said right-way passages include an inoperative sprinkler head.

9. The water maze amusement apparatus of claim 7, wherein a said motion sensor is associated with each operative sprinkler head.

* * * * *